United States Patent [19]

Copley et al.

[11] Patent Number: 4,702,614

[45] Date of Patent: Oct. 27, 1987

[54] BASEBALL ALARM CLOCK

[75] Inventors: Michael C. Copley, La Jolla; Alonzo W. Clark, IV, Poway, both of Calif.

[73] Assignee: Off-The-Wall Products, New York, N.Y.

[21] Appl. No.: 883,510

[22] Filed: Jul. 8, 1986

[51] Int. Cl.[4] ..... G04B 37/12; G04C 21/16

[52] U.S. Cl. ..... 368/72; 368/250; 368/262; 368/276

[58] Field of Search ..... 368/12, 69, 72, 262–263; 200/61.48, 61.50, 61.45 R

[56] References Cited

U.S. PATENT DOCUMENTS

| | | | |
|---|---|---|---|
| 3,686,878 | 8/1972 | Patrick et al. | 368/263 |
| 4,001,185 | 1/1977 | Mitsui et al. | 200/61.45 R |
| 4,036,007 | 7/1977 | Shelley | 368/69 |
| 4,115,995 | 9/1978 | Brien | 368/69 |
| 4,218,875 | 8/1980 | Rothman | 368/12 |
| 4,505,597 | 3/1985 | Flinn, Jr. | 368/262 |
| 4,585,358 | 4/1986 | Shay | 368/73 |

*Primary Examiner*—Vit W. Miska

[57] ABSTRACT

An alarm clock in the form of a sports ball has an alarm clock assembly with a snooze-type audio alarm which is temporarily silenced when the ball is thrown against a wall. The alarm clock ball has a feasible and resilient core of a foamed plastic, such as styrofoam, and an overlying cover of a plastic material. The clock assembly is mounted within a recess in the styrofoam core and has display and button controls which are visible and accessible through an opening in the plastic cover. The clock assembly has a quiet electrical switch which controls the snooze alarm mechanism and which is operated by a normally closed deceleration switch located in the foam core. The deceleration switch has a spring-biased metal ball in normal contact with two conductive contacts. When the alarm clock is thrown against a wall, the metal ball is displaced due to its inertia on impact thus temporarily breaking contact and silencing the alarm.

8 Claims, 6 Drawing Figures

BASEBALL ALARM CLOCK

FIELD OF THE INVENTION

This invention relates to alarm clocks, and is particularly related to an alarm clock which is in the form of a sports ball such as, for example, a baseball. More particularly, this invention relates to such sports ball alarm clocks having an audio alarm which can be silenced temporarily by throwing the clock against a wall or on a floor.

BACKGROUND OF THE INVENTION

Various types of alarm clocks have, over the years, found their ways into many households and institutions. Typically, all alarm clocks have an alarm set mechanism, and controls for silencing the alarm after it has been activated. Once awakened, the sleepy person using the alarm clock struggles with some difficulty to find the shut-off button or mechanism to turn off the alarm.

A relatively recent patent, i.e., U.S. Pat. No. 4,218,875 issued on Aug. 26, 1980 to Michael L. Rothman, describes an alarm clock in which the alarm is demountably attached to the clock. When the alarm is activated, it is removed from the clock and thrown against a wall in order to arrest the audible signal. The alarm mechanism includes an impact-sensitive switch which deenergizes a signal storage means. This is accomplished when, upon impact with the wall, the impact-sensitive switch is closed thereby deactivating the audio signal to quiet the alarm.

More recently, a "novelty alarm clock" has been described in U.S. Pat. No. 4,505,597 which issued on Mar. 19, 1985 to Jack L. Finn. This patent describes an alarm clock which is encased within a foam or a spongy body member defining a casing and shaped to resemble a basketball, a football or like objects. A trigger means disposed wholly within the casing is connected to an external push-button alarm shut off, and the casing is manipulable to permit pushing or pulling the push-button shut off. When the alarm is activated, the clock is thrown against a wall, and the impact on the external push button triggers the trigger means 113 which is disposed within the casing and closes the circuit, thus silencing the alarm.

In the alarm clock described by Finn, the clock is not externally visible without removing the plug 103 from the cavity 107. Moreover, the impact on the rigid surface 105*a* of the trigger assembly must be sufficient to bias the activating plate 111 against the trigger means 113 to quiet the audio signal. Thus, the alarm clock disclosed in Finn is not always reliable and it may become necessary for the person to get out of bed to shut off the alarm.

Accordingly, it is an object of the present invention to provide an alarm clock which overcomes the disadvantages of the alarm clocks described in the aforementioned patents of Rothman and Finn.

It is also an oject of this invention to provide an alarm clock in the form of a sports ball such as a baseball, football, basketball and like objects which, when the alarm sounds, is thrown against the wall, or on a floor, in order to silence the alarm.

It is a further object of the present invention to provide an alarm clock ball with a "snooze" type of alarm which will produce an audible buzz sound and, when the ball is thrown against the wall, will shut off the audio buzz sound until a predetermined time period has elapsed, at which time the audio buzz sound will automatically recommence.

It is another object of this invention to provide such a sports ball alarm clock which is of sufficient strength and resiliency so that neither the ball itself nor its internal alarm clock mechanism is damaged by the impact of the ball against the wall.

It is still a further object of this invention to provide such alarm clocks in which the time display is externally visible to the user and in which the buttons controlling the various functions of the clock are readily accessible to the user without removal of the cover or other protective device.

It is still a further object of the present invention to provide such an alarm clock ball which may be used repeatedly without damage to its clock assembly or its snooze alarm mechanism.

The foregoing and other objects and features of this invention will be more fully appreciated from the ensuing description and the accompanying drawings.

SUMMARY OF THE INVENTION

The present invention provides a novel alarm clock which is in the form of a sports ball such as a baseball, basketball, football, golfball and the like objects, though it can assume other configurations so long as it embodies the principles set forth herein. The alarm clock of this invention comprises a core of a foam plastic material such as styrofoam and an outer covering whose external surface bears indicia an markings to simulate a particular type of a sports ball. Conveniently, the outer cover may be about ¼ inch thick and it may be made of a suitable vinyl plastic or other plastic material. The ball cover has an access opening and a recess which extends partially into the styrofoam core. A clock assembly is mounted by fitting into the recess and has its face set in relative to the ball cover so as to prevent damage to the clock upon impact against a wall. The clock face has a time display and button controls which are visible through the opening in the cover.

The clock assembly comprises a quiet electrical switch which controls the alarm and which is activated by a normally closed deceleration switch located within the styrofoam core. The deceleration switch comprises a frame, a pair of electrically conductive contacts mounted in said frame and a conductive metal ball which in its normal closed position is in contact with said conductive contacts. A coil spring has one end attached to the metal ball and has its other end attached to the switch frame. The spring normally urges the metal ball against the contacts to maintain a closed circuit when the alarm sounds. Upon impact against a wall, the metal ball is displaced by its own inertia and moves away from the contacts by biasing the spring toward the frame, thus opening the circuit and silencing the alarm. Once the alarm clock comes to rest, the spring expands urging the conductive metal ball back in contact with the conductive contacts to once again close the circuit and reactivate the alarm.

BRIEF DESCRIPTION OF THE DRAWINGS

In the drawing, wherein like reference numerals are employed to designate like parts.

DETAILED DESCRIPTION OF THE INVENTION

Figure 1:
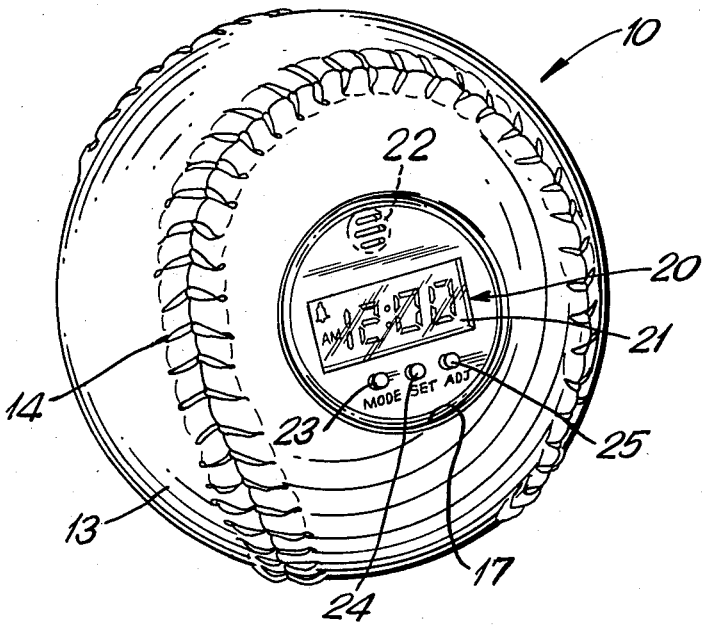
FIG. 1 is a perspective view of an alarm clock in accordance with one embodiment of the invention in the form of a baseball.
Figure 3:
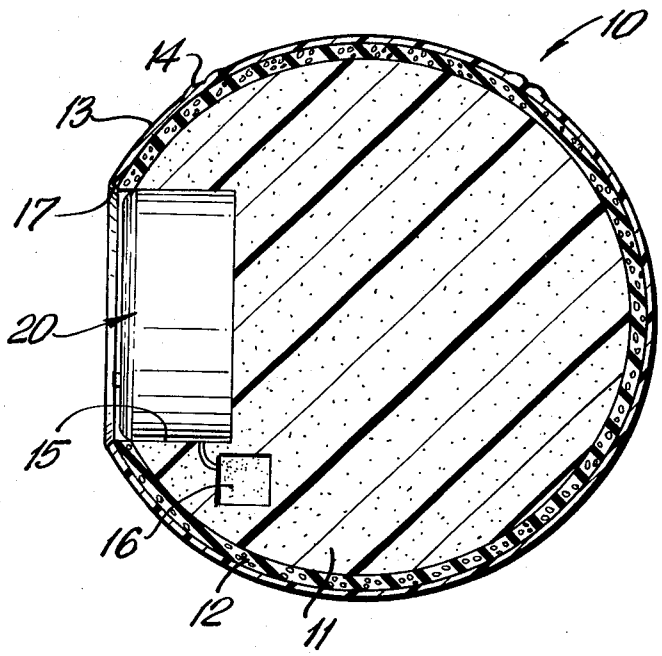
FIG. 3 is a cross-sectional view taken along the line A—A of FIG. 2.
Figure 2:
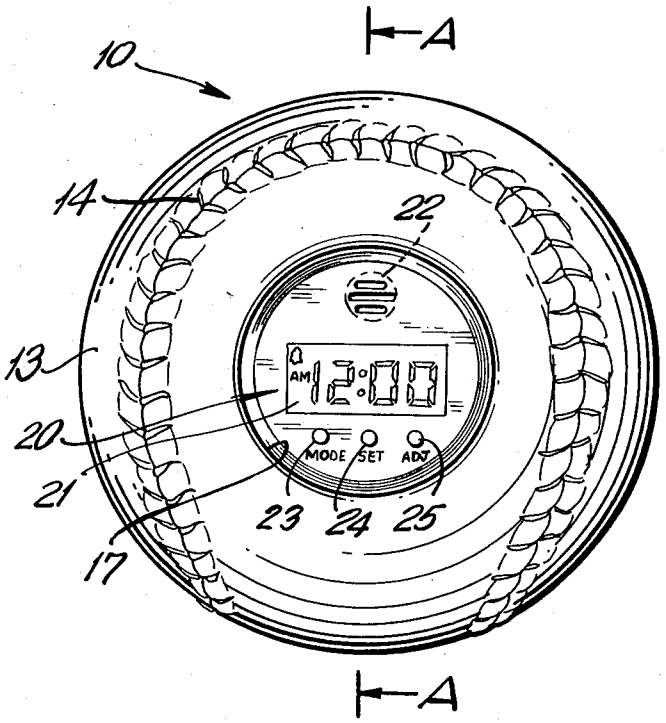
FIG. 2 is a front plan view of the baseball alarm clock shown in FIG. 1.

Referring first to FIGS. 1–3 of the drawings, the alarm clock 10 is shown, in FIG. 1, as a generally spherical object made of a styrofoam core 11 or any other resilient plastic or rubber material. The styrofoam core 11 is covered with an overlying soft foam wrapper 12 and a vinyl plastic covering 13 whose exterior surface bears markings or indicia 14 to simulate a baseball. While the present invention will hereinafter be described with reference to a baseball alarm clock, it will become obvious from the description herein that the shape and surface configurations of the ball may vary to resemble a basketball, football, golfball and the like and other objects.

Figure 5:
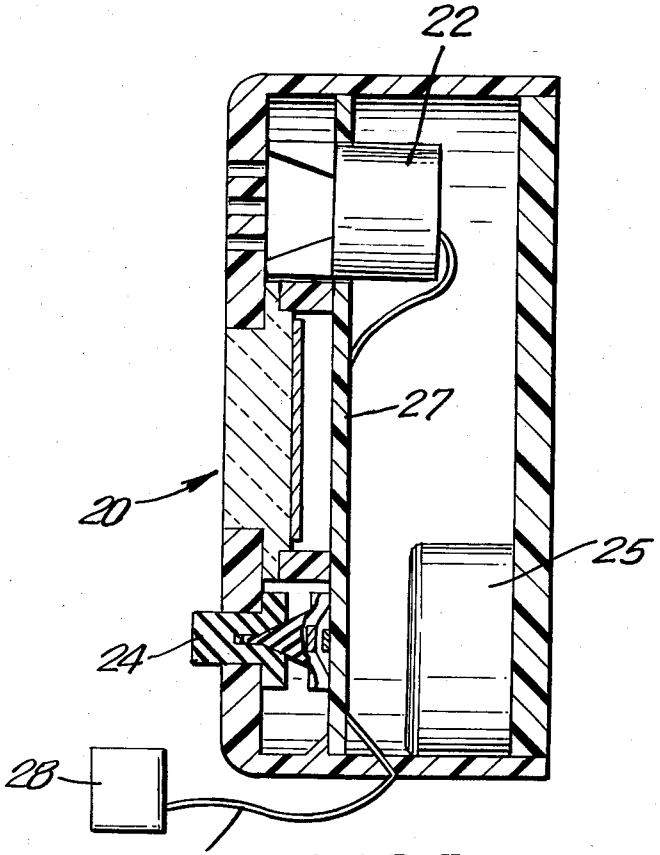
FIG. 5 is a cross-sectional view taken along the line B—B of FIG. 4.
Figure 4:
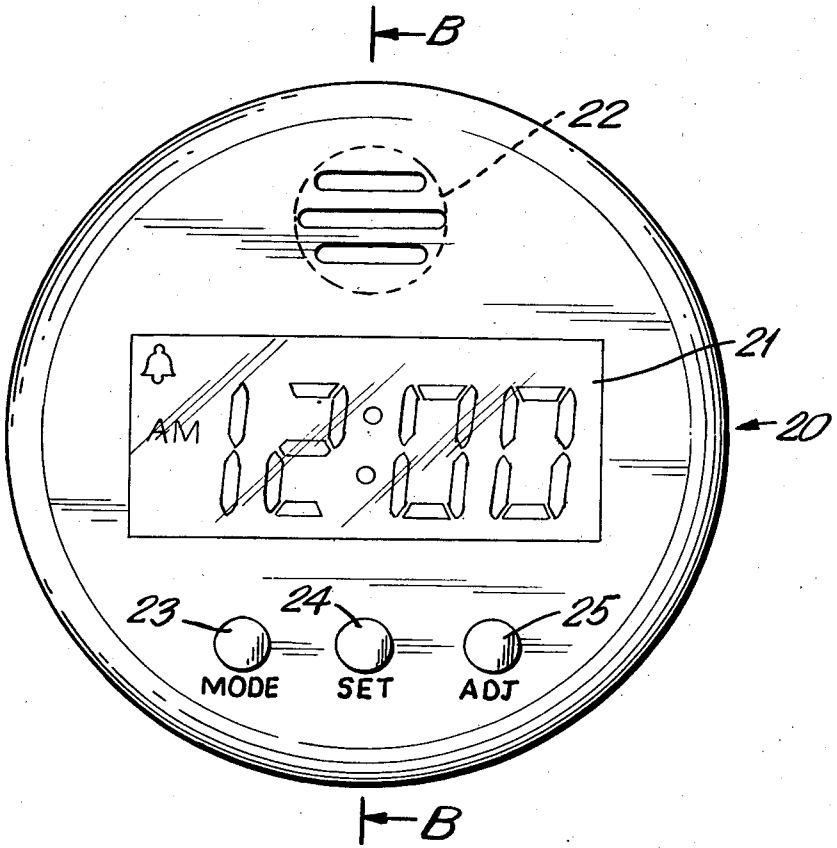
FIG. 4 is an enlarged front plan view of the clock assembly used as part of the alarm clock of the present invention.

As shown in FIGS. 3–5, a recess 15 formed through the opening access 17 in the vinyl plastic cover 13 extends partially into the foam core 11. An alarm clock 20 is mounted within and fits snugly into the recess 15. The alarm clock 20 has a time display surface 21 which is visible through the opening 17. Preferably, the time display 17 is a planar digital display formed of liquid crystal display (L.C.D.). The time display 21 shows the correct time and, in its set mode, will also display the time at which the alarm will ring. The clock is sufficiently recessed relative to the surface of the ball so that it is not damaged when the ball is thrown against the wall.

The alarm clock assembly 20 includes an audio device 22, preferably a buzzer which buzzes when it is activated. As seen in FIG. 4, the face of the alarm clock 20 has buttons to control the clock functions. These include a mode selector button 23 which sets the alarm, a set button 24 which turns off the alarm and an adjustment button 25 for adjusting the time.

Referring now to FIG. 5, the alarm clock assembly is shown to include a battery 25 which operates the assembly and an alarm silencing means 26 which is preferably a "snooze" alarm. In a snooze alarm, when the alarm silencing means is activated, the alarm buzzer 22 will be turned off for a predetermined time period. After such predetermined time lapse (i.e., time delay), the alarm buzzer will begin buzzing until it is turned off. This will be explained hereinafter in more detail.

The clock assembly further includes a printed circuit board 27 and a deceleration switch 28 which is in electrical communication with the printed circuit board by a pair of electrical conductors 29. The deceleration switch 28 is disposed in a cavity 16 in the styrofoam core 11. Preferably the deceleration switch 28 is mounted on the back of the printed circuit board. The details and function of the deceleration switch 28 will now be described in reference to FIG. 6.

Figure 6:
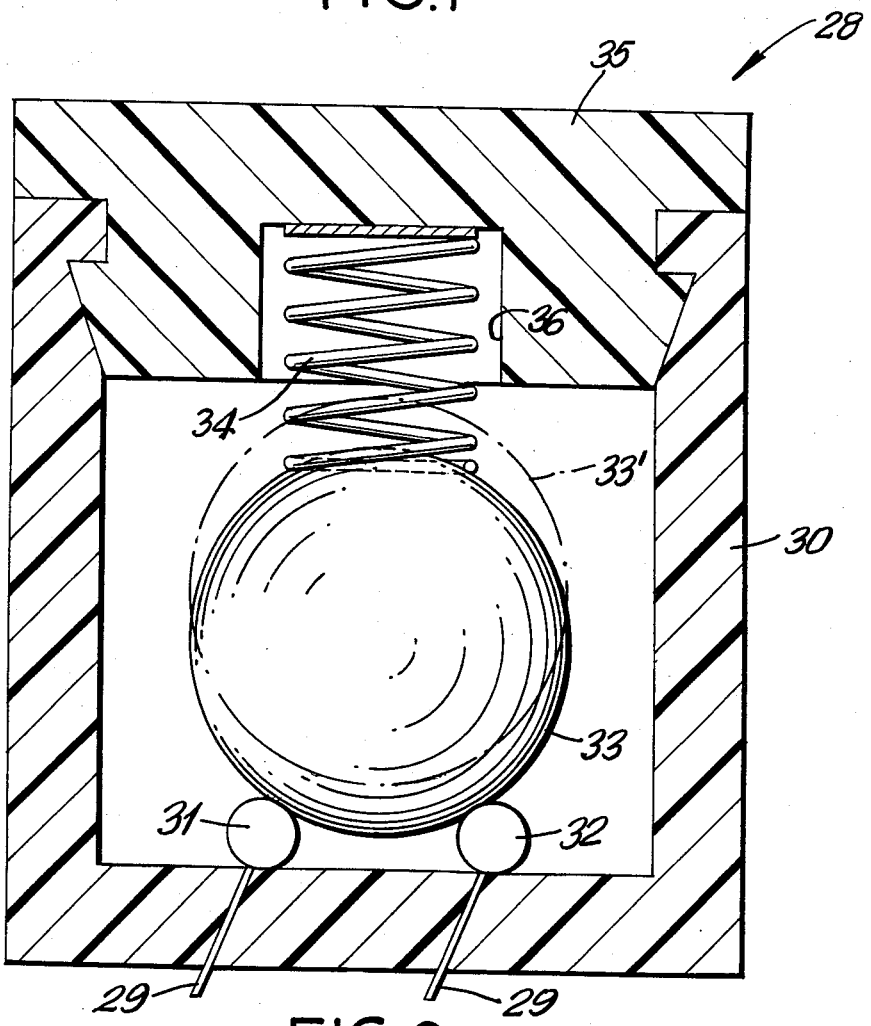
FIG. 6 is an enlarged cross-sectional view of the deceleration switch assembly used in the alarm clock of this invention.

In the specific embodiment shown in FIG. 6, the deceleration switch 28 comprises a frame or housing 30 conveniently made of an injection-molded plastic. A pair of electrically conductive contacts 31 and 32 are mounted on the bottom of the frame 30 and an electrically conductive metal ball 33 is held within the frame 30. The metal ball 33 is normally urged against the electrically conductive contacts 31 and 32 and is held at that position by the coil spring 34. The coil spring 34 has one end attached to the top of the metal ball 33 and is housed partially within the pocket 36 in the frame top 34. The other end of the coil spring 35 is attached to the frame top 35 within the pocket 36.

In operation, when the alarm sounds, the user picks up the baseball alarm clock and throws it against a wall, or on a floor. Upon impact, the metal ball 33, due to its mass (inertia), is displaced as shown by 33′ in FIG. 6, urged toward the frame top 35 and compresses the coil spring 34. This forward movement or displacement of the metal ball 33 away from the electrical contacts 31 and 32 opens the circuit by breaking contacts with the conductors 29. Accordingly, the audio signal or snooze alarm is temporarily interrupted and silenced for a predetermined period of time set by the clock circuit. After a moment, the metal ball will be urged back toward its normal position. Thus, the metal ball will reestablish contact with the electrical contacts 31 and 32 and conductor 29. After the predetermined time, once again the audio signal is activated until it is turned off by the button 24 or by throwing the ball against a wall.

While the alarm clock of this invention has been described with a certain degree of particularity, it is readily appreciated that some changes may be made in its structure or manner of operation which are nevertheless contemplated by, and are within the scope of the present invention. For example, it can be appreciated that depending, inter alia, on the tension in the spring and the mass of the conductive metal ball in the deceleration switch, the alarm can be silenced by strongly shaking the ball so as to displace the conductive metal ball away from the electrical contacts and thus open the circuit. In another embodiment, the clock mechanism is counter-weighted by a washer or other weight (not shown) aligned with the clock mechanism and positioned in a cavity in the ball opposite the clock mechanism. The counterweight provides that the ball will tend to come to rest face up after it has been thrown, i.e., with the clock face exposed to the view.

Also, the deceleration switch may have a time delay, such as a resistor-capacitor circuit, so that the ball will come to rest before the alarm is shut off. Alternatively, the deceleration switch is a normally off switch, for example, a ball positioned between two springs which contacts a wall upon deceleration, the electrodes being the spring and the wall. Other changes are suggested to those skilled in the art from the foregoing description and the drawings illustrating the alarm clock of this invention.

What is claimed is:

1. An electronic alarm clock having an audio alarm which is quieted when the alarm clock is thrown against a wall, said alarm clock comprising:

(a) a generally spherical-shaped casing having a flexible and resilient core and an external cover having an opening therein;

(b) a recess in said core extending from said cover partially into said core;

(c) an electronic alarm clock assembly mounted within said recess, said assembly having an electric battery and a digital liquid crystal time display normally visible through said opening in said cover without disassembling said spherical-shaped casing, said time display being substantially flus with said cover;

(d) control means for controlling the functions of said clock, said control means being operatively associated with said alarm clock assembly and being normally visible and accessable through said opening without disassembling said spherical-shaped casing;

(e) a printed circuit board including an alarm quiet means for silencing said alarm; and (f) a switch means electrically connected to said alarm quiet means and disposed within said core, said switch means being a deceleration inertial switch operative upon impact when said alarm clock is thrown against a wall to activate said alarm quiet means and silence said alarm.

2. An alarm clock as in claim 1 wherein said deceleration switch means comprises a frame member, a pair of electrically conductive contacts mounted on said frame member, a conductive metal ball within said frame member and in normal contact with aid conductive contacts, a spring means having one end attached to said metal ball and the other end attached to said frame member, said spring means normally urging said metal ball against said conductive contacts, wherein when said alarm clock is thrown against said wall, said metal ball is displaced in said frame and breaks contacts with said electrically conductive contacts to open the electrical circuit and thereby silencing the alarm.

3. An alarm clock as in claim 1 wherein said audio alarm is a snooze-type alarm which, after being silenced for a predetermined period of time, is automatically reactivated.

4. An alarm clock as in claim 2 wherein after a predetermined period of time, said spring means urges said conductive metal ball back to its normal position to contact said electrical contacts and thereby close the circuit and reactivate said alarm.

5. An alarm clock as in claim 1 wherein said casing is in the form of a sports ball and said cover bears indicia and markings to simulate said sports ball.

6. An alarm clock as in claim 2 wherein said casing is in the form of a sports ball and said cover bears indicia and markings to simulate said sports ball.

7. An alarm clock as in claim 3 wherein said casing is in the form of a sports ball and said cover bears indicia and markings to simulate said sports ball.

8. An alarm clock as in claim 4 wherein said casing is in the form of a sports ball and said cover bears indicia and markings to simulate said sports ball.

* * * * *